US009061195B1

(12) United States Patent
Collins

(10) Patent No.: US 9,061,195 B1
(45) Date of Patent: Jun. 23, 2015

(54) SWING TRAINING SHIRT

(76) Inventor: Fred Collins, Houston, TX (US)

( * ) Notice: Subject to any disclaimer, the term of this patent is extended or adjusted under 35 U.S.C. 154(b) by 905 days.

(21) Appl. No.: 13/271,339

(22) Filed: Oct. 12, 2011

Related U.S. Application Data

(60) Provisional application No. 61/394,891, filed on Oct. 20, 2010.

(51) Int. Cl.
*A63B 69/36* (2006.01)

(52) U.S. Cl.
CPC ..... *A63B 69/36* (2013.01)

(58) Field of Classification Search
CPC ..... A63B 69/36; A63B 69/3608; A41B 1/00
USPC ..... 473/207, 212, 215
See application file for complete search history.

(56) References Cited

U.S. PATENT DOCUMENTS 1,600,897 A * 9/1926 Lesser ..... 2/269
2,447,989 A * 8/1948 Previdi ..... 2/125
4,058,852 A * 11/1977 Aragona ..... 2/115
4,892,317 A * 1/1990 Corder, Jr. ..... 473/212
5,267,352 A 12/1993 Rodarmel
5,688,137 A * 11/1997 Bustance ..... 434/247
5,890,968 A 4/1999 Mingo
5,924,133 A * 7/1999 Zapiti ..... 2/77
5,951,408 A * 9/1999 Inman ..... 473/212
6,024,091 A 2/2000 Bennett
7,985,144 B1 * 7/2011 Gonzales ..... 473/212

* cited by examiner

*Primary Examiner* — Raleigh W Chiu
(74) *Attorney, Agent, or Firm* — Buskop Law Group, PC; Wendy Buskop

(57) ABSTRACT

A swing training shirt for training a user to perform proper swings can include a shirt body configured to fit closely against a body of the user and sleeves configured to fit closely about the user's arms. A side of the sleeves can be selectively engaged and disengaged from the shirt body to restrain movement of the user's arms away from the user's torso. The swing training shirt can allow the user to maintain the user's arms in sync with a rotation of the user's torso during execution of swings; thereby allowing the user to synchronously control and coordinate movement of the user's torso and arms during swings.

15 Claims, 7 Drawing Sheets

SWING TRAINING SHIRT

CROSS REFERENCE TO RELATED APPLICATIONS

The present application claims priority to and the benefit of U.S. Provisional Patent Application Ser. No. 61/394,891 filed on Oct. 20, 2010, entitled "GOLF SWING TRAINING SHIRT", which is incorporated in its entirety herewith.

FIELD

The present embodiments generally relate to a swing training shirt which can have sleeves that are attachable to a shirt body for confining a user's arms for proper execution of a swinging motion and for providing tactile signals to the user; thereby allowing the user to develop a muscle memory of a proper swinging motion.

BACKGROUND

A need exists for a swing training shirt with sleeves that attach to the shirt body to confine the user's arms at a correct position relative to the user's body, allowing the user to synchronize movement of the user's arms with a rotation of the user's torso for proper execution of a swinging motion.

A further need exists for a swing training shirt that fits against the user's torso and arms tightly enough to provide the user with tactile signals without preventing the user from executing a swing; thereby allowing the user to feel the proper swinging motion and develop muscle memory for proper execution of the swinging motion.

The present embodiments meet these needs.

BRIEF DESCRIPTION OF THE DRAWINGS

The detailed description will be better understood in conjunction with the accompanying drawings as follows.

Figure 1A:
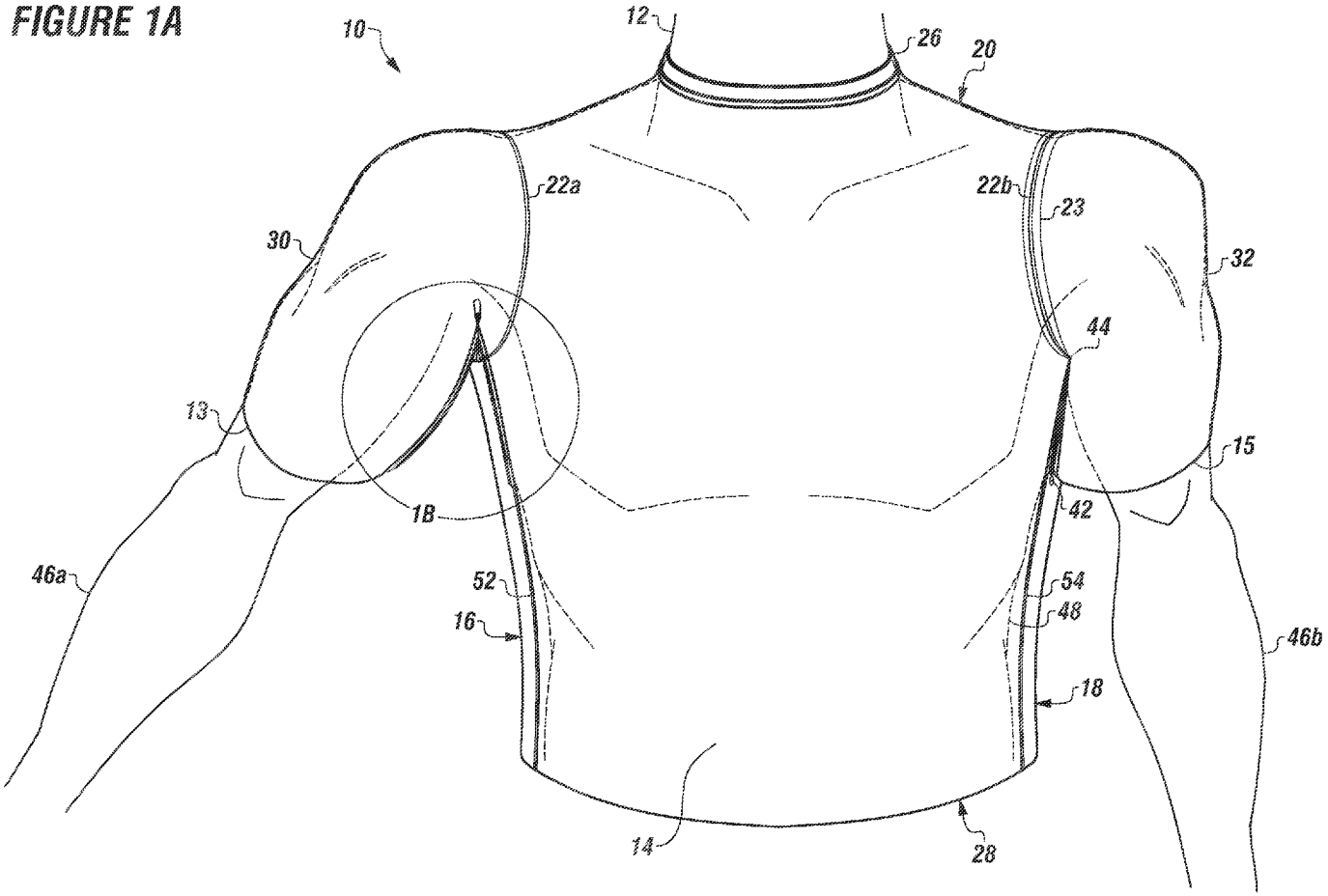
FIG. 1A depicts the swing training shirt having zippers as connectors for attaching the sleeves to the shirt body according to one or more embodiments.

The present embodiments are detailed below with reference to the listed Figures.

DETAILED DESCRIPTION OF THE EMBODIMENTS

Before explaining the present apparatus and method in detail, it is to be understood that the apparatus and method are not limited to the particular embodiments and that the embodiments can be practiced or carried out in various ways.

The present embodiments relate to a swing training shirt for a user to wear while practicing a swinging motion.

The swing training shirt can be used to assist users in the development of confidence in performing swings, such as golf swings, in-part because the user can develop consistency in their swings. The swing training shirt can enable the user to have confidence in their swings and can allow the user to have a free and relaxed swinging motion, and to fix their visual focus on a target, such as a target portion of a golf course. For example, the swing training shirt can enable users to achieve longer and better directional drives of golf balls. The swing training shirt can also be used to train for putting and driving the golf ball, as well as for training swinging motions for other sports.

The swing training shirt can allow users to practice complete swings, including back swings and front swings simultaneously in a single stroke rather than practicing just a portion of the swing.

The swing training shirt can reduce the number of injuries associated with swinging motions, such as back problems caused by incorrect swinging motions or rotating improperly during a swing.

One or more embodiments of the swing training shirt can reduce or eliminate excessive hand and wrist motion during a swing; thereby reducing or eliminating hand and wrist damage caused by improper swinging motions.

One or more embodiments of the swing training shirt can be used to improve a user's short game, chipping, putting, short shots, and other golfing actions by providing a smoother swinging motion leading to more solid contact with the ball by the user while wearing the swing training shirt.

The swing training shirt can have a shirt body, which can be a stretchable shirt body. The stretchable shirt body can stretch along with the user's body motions in one or more directions.

The shirt body can fit closely against the user's torso and arms without being tight enough to prevent movement of the user's arms to perform the swinging motion.

The shirt body can include a right side, left side, top side, right opening on a portion of the right side, left opening on a portion of the left side, collar on a portion of the top side, and bottom opening.

The collar can be a round collar, V-neck collar, closed spandex collar, an open collar, a closeable collar, or combinations thereof. The collar can be sewn to the shirt body and can form a border around an opening on the top side of the shirt body.

The right opening, left opening, and bottom opening can be circular, elliptical, or another shape, and can have any diameter. For example, the right opening and left opening can each have a diameter ranging from about three inches to about fifteen inches. The bottom opening can be sized to closely fit about the user's torso. The user can be a man, women, or child.

The swing training shirt can include a right sleeve connected to the right opening and a left sleeve connected to the left opening. In one or more embodiments, the right sleeve and left sleeve can be made of different materials with similar properties.

In one or more embodiments, each sleeve can be from about four inches to about twelve inches in length. The sleeves can be long sleeves, short sleeves, or banded sleeves.

The right opening and left opening can be disposed proximate the top side of the shirt body. The right sleeve can connect to the right opening at a right sleeve first end, forming a right armpit. A right sleeve second end of the right sleeve can be configured to fit closely about the user's right arm, such as about the user's right bicep.

The left sleeve can connect to the left opening at a left sleeve first end, forming a left armpit. A left sleeve second end of the left sleeve can be configured to fit closely about the user's left arm, such as the user's left bicep.

The swing training shirt can have a right connector configured to engage the right sleeve with a portion of the right side of the shirt body.

The right connector can be a right zipper which can have a first portion of a track disposed along the right sleeve, a second portion of the track disposed along the shirt body below the right opening, and a right zipper slider engaged with the first and second portions of the track of the right zipper. The right zipper slider can be used to zip close the right sleeve to the right side of the shirt body and to unzip the right sleeve from the right side of the shirt body.

The golf swing training shirt can have a left connector configured to engage the left sleeve with a portion of the left side of the shirt body.

The left connector can be a left zipper which can have a first portion of track disposed along the left sleeve, a second portion of track disposed along the shirt body below the left opening, and a left zipper slider engaged with the first and second portions track of the left zipper. The left zipper slider can be used to zip close the left sleeve to the left side of the shirt body and to unzip the left sleeve from the left side of the shirt body.

The right connector can have an opened position, with the right sleeve disengaged from the right side of the shirt body. The right connector can have a closed position, with the right sleeve engaged with the right side of the shirt body.

The left connector can have an opened position, with the left sleeve disengaged from the left side of the shirt body. The left connector can have a closed position, with the left sleeve engaged with the left side of the shirt body.

In one or more embodiments, the zippers can be nylon zippers, metal zippers, or another type of zipper. The zippers can be any length to fit the size of the user. For example, the zippers can be from about six inches long to about eight inches long.

The zippers can be used to provide a close and snug fit between the sleeves and the shirt body.

The right connector and left connector can also be buttons with button holes, snaps, hook and loop type fasteners, another fabric fastening means, or combinations thereof.

In operation, when the right sleeve is engaged with the portion of the right side of the shirt body and the left sleeve is engaged with the portion of the left side of the shirt body, movement of the user's arms can be restrained by the right sleeve and left sleeve. As such, during execution of a swinging motion by the user, the user's arms can be maintained in synchronization with the movement of the user's torso.

The swing training shirt can be configured to fit the user such that the swing training shirt provides the user's arms with sufficient freedom of movement while also maintaining the user's arms close enough to the user's upper body, such as between one and three inches of the user's upper body.

The swing training shirt can be configured to fit closely to the user's body to provide the user with tactile signals during the swings. The tactile signals can be a pulling motion on the arms of the user when the swing is occurring incorrectly. The tactical signals can be excessive stretching in the sleeves and shirt body.

The swing training shirt can be flexible to provide the user with a range of motion during swings. For example, the swing training shirt can be made of one or more of the following materials: a material having bidirectional stretchable and non-deforming properties, such as a bike racer's shirt; SPANDEX™ cloth, woven NYLON™ cloth, mixtures of NYLON™ cloth and cotton, mixtures of NYLON™ cloth and SPANDEX™ cloth, or combinations thereof. In one or more embodiments, the swing training shirt can be made of a material having an elasticity that allows the swing training shirt to return to its original shape after use and washing.

In one or more embodiments, the swing training shirt can have a sun protection factor (SPF), such as an SPF of fifty. The swing training shirt can be made at least in part of a wind resistant material. The swing training shirt can have polypropylene or another moisture wicking material.

The collar of the swing training shirt can be configured to receive the user's head. The right sleeve can be configured to receive the users' right arm. The left sleeve can be configured to receive the user's left arm. The bottom opening can be configured to receive a portion of the user's torso.

In one or more embodiments, the swing training shirt can be configured to be worn over another shirt. For example, the swing training shirt can be a jacket or over-shirt that the user can wear over another shirt, such as a traditional golf shirt. The thinness of the swing training shirt can allow the user to wear the swing training shirt as insulation on a cold day, enabling the user to practice in more frigid climates. The swing training shirt can also be worn independently without another shirt.

In one or more embodiments, the shirt body can include a right inseam and left inseam.

A portion of the right connector, such as the right zipper, can extend from beneath the right armpit and along the right inseam from the right arm opening. Another portion of the right connector can be connected to an inner side of the right sleeve.

A portion of the left connector can extend from beneath the left armpit and along the left inseam from the left arm opening. Another portion of the left connector can be connected to an inner side of the left sleeve.

Proper golf swings or other swinging motions can be implemented by coordinating the motions of the user's body and the swinging of the user's arms. The training shirt can allow the user to maintain the motion of the user's hips, arms, and torso in one continuous line, which can eliminate the need of the user to focus on individual movements of the user's body. In operation, the swing training shirt can allow users to coordinate swings, such as coordinating the rotation of the user's torso and the swinging of the user's arms. For example, the swing training shirt can allow the user to synchronously control and coordinate movements of the user's torso, left arm, and right arm during swinging and hitting of balls, such as golf balls.

Due to the confinement of the user's arms near the user's torso, the swing training shirt can enable the user to feel each swing rather than having to think about a position of the user's arms. As such, the swing training shirt can allow a novice that has not tried golfing or another sport to learn how a swinging motion feels; thereby allowing the novice to learn through muscle memory.

In operation, when the user is wearing the swing training shirt while performing swings and/or hitting balls, the right connector and left connector can maintain a position of the user's arms with respect to the user's torso, allowing the user to maintain the user's left arm and right arm in sync with a rotation of the user's torso during swings.

The swing training shirt can train the user to have a unified swinging motion by holding the user's arms close but resistively near the user's torso. As such, the user can execute swings with the proper form without moving the user's arms too far away from the user's torso. Additionally, the close fit of the swing training shirt can provide the user with the tactile signals during the properly executed swings for developing the muscle memory of the proper swinging motion.

The swing training shirt can allow users to train their swings without over thinking; which can lower stress related to swing training. For example, the swing training shirt can allow the user to feel for a repeatable swing motion by providing the tactile signals to the user with the closely fitting portions of the swing training shirt. The closely fitting portions of the swing training shirt can engage the user's body throughout the swing motion; thereby providing the tactile signals to the user. As such, the user can memorize the feel of the tactile signals associated with a proper swing, allowing the motion of a proper swing to be repeatable through muscle memory. The sensory input, in the form of the tactile signals, provided by the swing training shirt can allow for repeatable swings from one practice to the next, faster development of muscle memory, and faster improvement of golfing skills.

In one or more embodiments, the swing training shirt can have a tightening mechanism on a back side of thereof, allowing the user to tighten the swing training shirt to provide a more snug fit about the user. For example, the tightening mechanism can be a zipper, hook and loop fastener, string and tie points, or the like for tightening the back side of the swing training shirt about the user.

In one or more embodiments, the swing training shirt can have one or more tabs connected thereto. For example, a first tab can be connected at or above the connection of the right connector with the right sleeve and/or the right side of the shirt body, and a second tab can be connected at or above the connection of the left connector with the left sleeve and/or the left side of the shirt body.

In operation, after a user puts the swing training shirt on, the user can hold the first tab while closing the right connector. The first tab can allow the user to apply tension to the shirt body and right sleeve, allowing the right connector to engage the right sleeve with the right side of the shirt body. For example, if the right connector is a zipper, the first tab can be held by the user to allow the zipper to be closed.

In operation, after a user puts the swing training shirt on, the user can hold the second tab while closing the left connector. The second tab can allow the user to apply tension to the shirt body and left sleeve, allowing the left connector to engage the left sleeve with the left side of the shirt body. For example, if the left connector is a zipper, the second tab can be held by the user to allow the zipper to be closed.

In one or more embodiments, the one or more tabs can be connected, such as by sewing, to an outside of the shirt body. Also, the one or more tabs can be connected, such as by sewing, onto an inner portion of a seam of the sleeves to the shirt body.

In one or more embodiments, to use the swing training shirt, a user can move the right connection and left connector to a disengaged closed position.

The user can insert the user's head through the bottom opening and the collar.

The user can insert the user's right arm into the right sleeve and the user's left arm into the left sleeve. The user can pull the shirt body over at least a portion of the user's torso. The bottom opening can fit proximate the user's waist. Each sleeve can fit about the user's arm above an elbow, and the collar can fit about the user's neck.

Once the swing training shirt is disposed over the user's torso and arms, the right connector and left connector can be moved into an engaged closed position; thereby engaging the right sleeve and left sleeve with the shirt body. The user can then practice swinging motions, such as golf swings, to develop a muscle memory of the proper swinging motion.

Figure 1B:
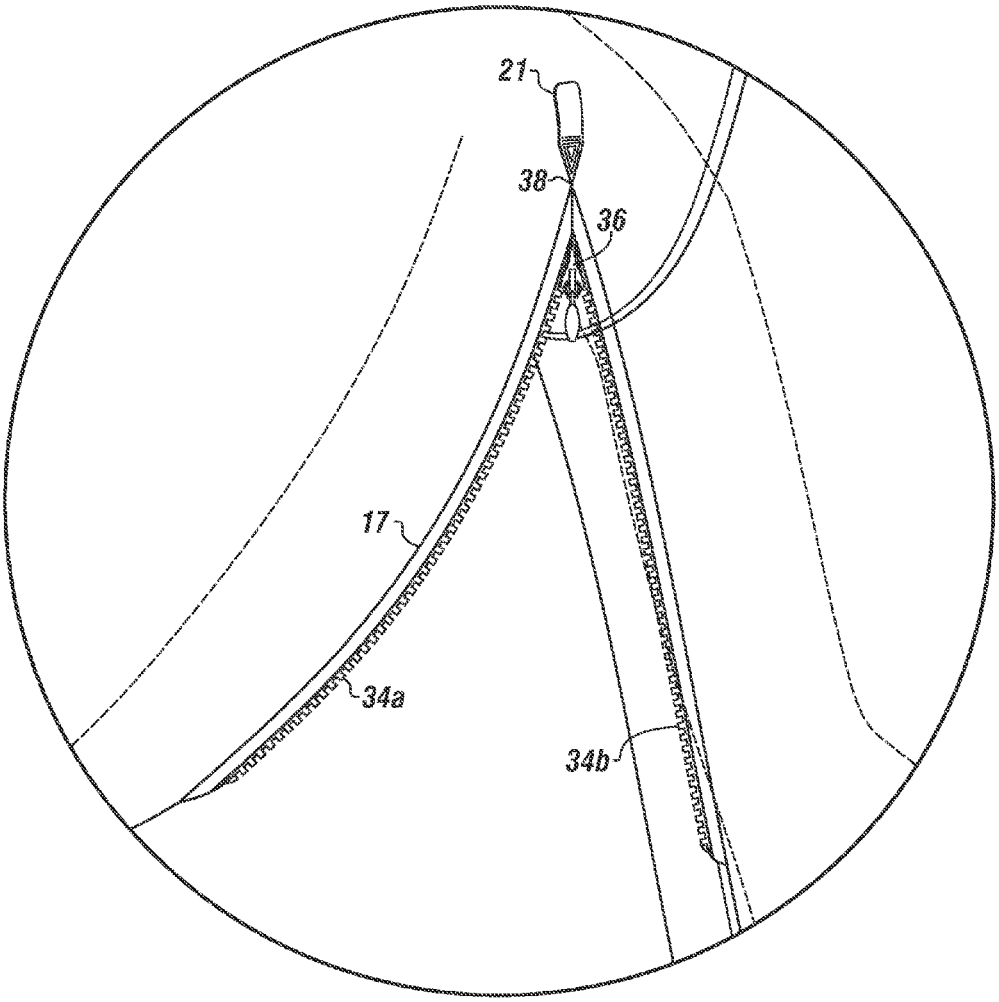
FIG. 1B depicts a detail of a right sleeve disengaged from a right side of the shirt body according to one or more embodiments.
Figure 1C:
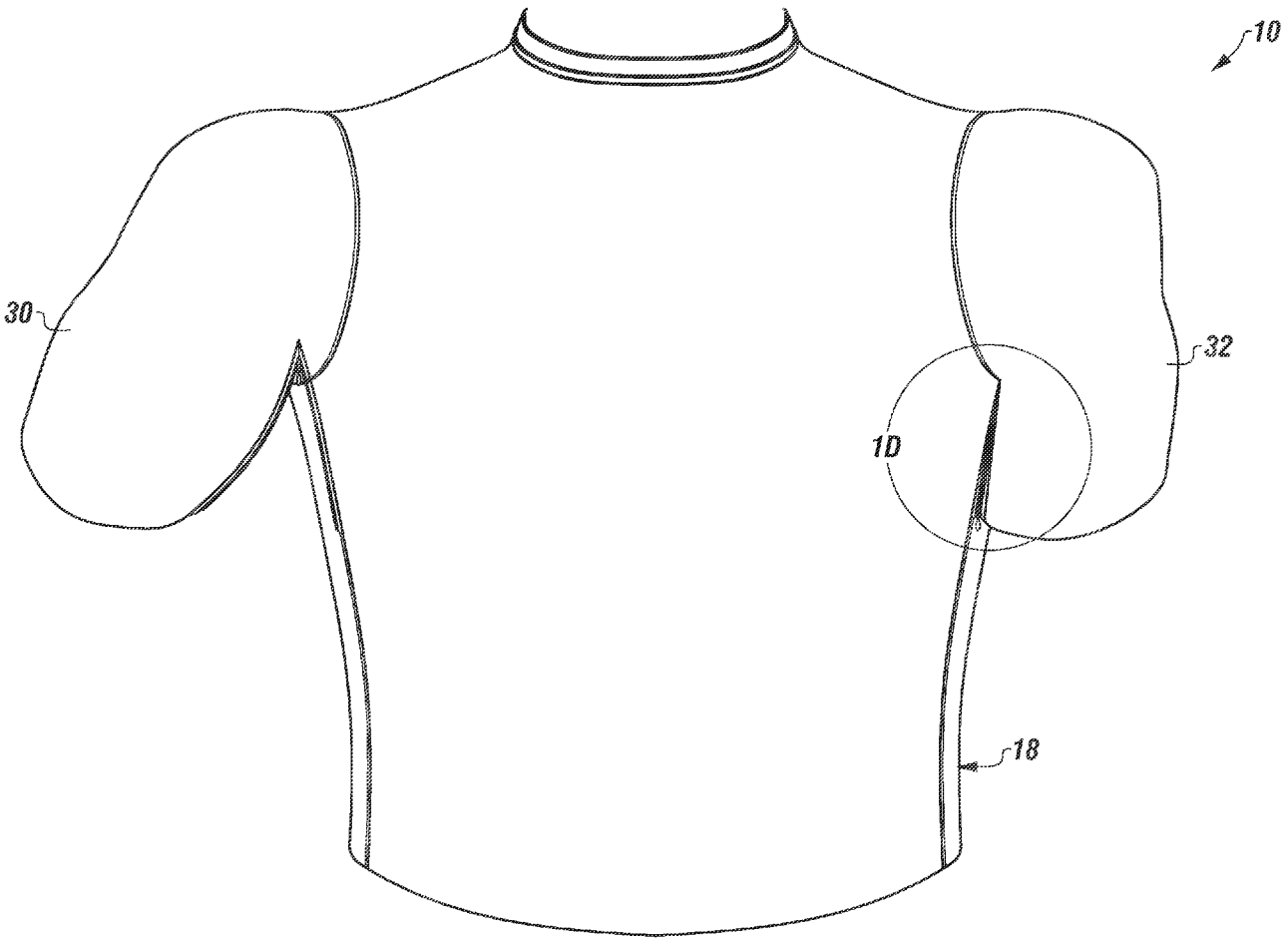
FIG. 1C depicts the swing training shirt according to one or more embodiments.
Figure 1D:
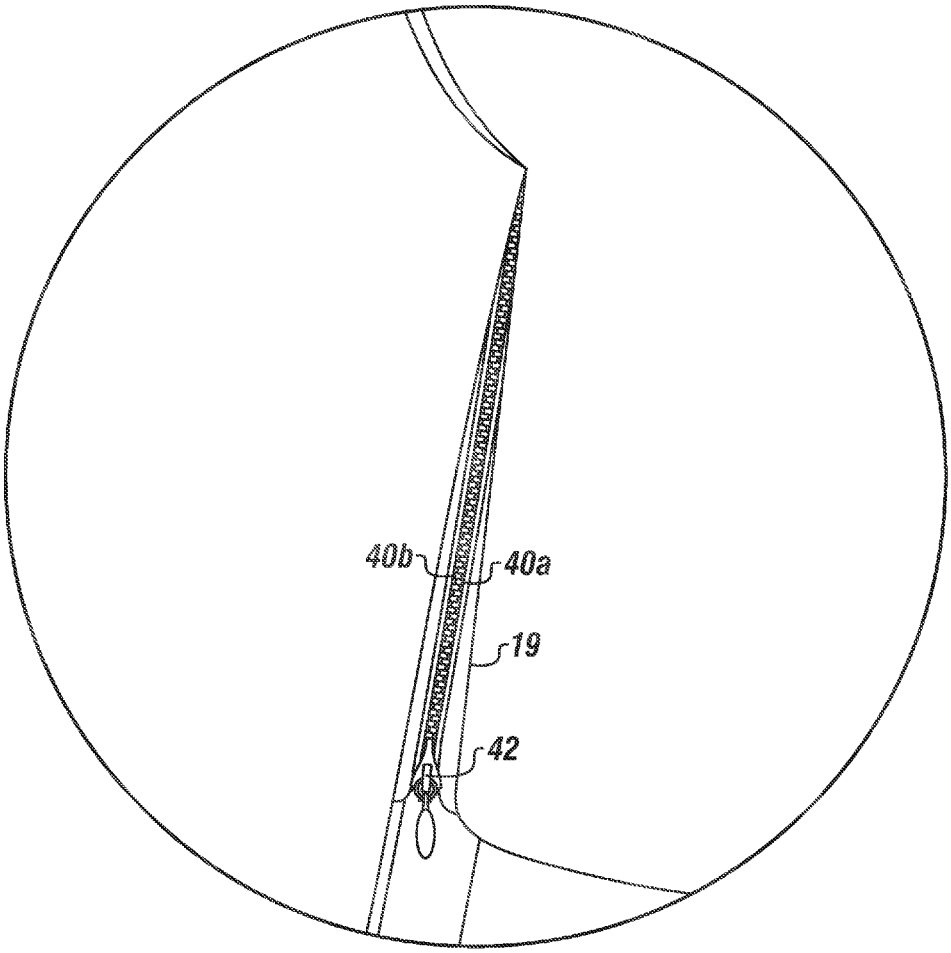
FIG. 1D depicts a detail of a left sleeve engaged with a left side of the shirt body according to one or more embodiments.

Turning now to the Figures, FIG. 1A depicts an embodiment of a swing training shirt 10 on a user 12, FIG. 1B depicts a detail view of a portion of FIG. 1A showing a right connector 36 in an open configuration, FIG. 1C depicts the swing training shirt 10, and FIG. 1D depicts a detail view of a portion of FIG. 1C showing a left connector 42 in a closed configuration.

The swing training shirt 10 can be used in training the user 12 to execute swings. The swing training shirt 10 can be configured for training a golf swing, baseball swing, tennis swing, cricket swing, another sports swing, or combinations thereof.

The swing training shirt 10 can have a shirt body 14, which can be configured to be worn on a torso 48 of the user 12.

The swing training shirt 10 can have a right sleeve 30 connected with the shirt body 14, such as at a right seam 22*a*. The right sleeve 30 can be configured to be worn on a right arm 46*a* of the user 12.

The swing training shirt 10 can have a left sleeve 32 connected with the shirt body 14, such as at a left seam 22*b*. The left sleeve 32 can be configured to worn on a left arm 46*b* of the user 12.

The shirt body 14 can have a top side 20, right side 16, left side 18, and bottom opening 28. The bottom opening 28 can be configured to receive a portion of the user's torso 48.

A right opening can be formed on a portion of the right side 16, such as at the right seam 22*a*. The right sleeve 30 can be connected to the right opening.

A left opening can be formed on a portion of the left side 18, such as at the left seam 22*b*. The left sleeve 32 can be connected to the left opening.

A collar 26 can be formed on a portion of the top side 20. The collar 26 can be configured to receive the user's head. In one or more embodiments, the collar 26 can be a round collar, V-neck collar, closed spandex collar, open collar, closeable collar, any shirt collar, or combinations thereof.

The swing training shirt 10 can be configured to fit closely to the user's torso 48 and arms 46*a* and 46*b* to provide the user 12 with tactile signals during execution of swings.

The swing training shirt 10 can be made of a flexible material to provide the user 12 with a range of motion during execution of swings. The swing training shirt 10 can be made of a stretchable material, wind resistant material, material having a sun protection factor, material having wicking properties, or combinations thereof.

In one or more embodiments, the swing training shirt 10 can be configured to be worn by the user 12 under another shirt or over another shirt.

The swing training shirt 10 can have a right connector 36 configured to engage at least a portion of an inner side of the right sleeve 17 with a portion of the right side 16 of the shirt body 14, a left connector 42 configured to engage at least a portion of an inner side the left sleeve 19 with a portion of the left side 18 of the shirt body 14, or combinations thereof.

In one or more embodiments, the right connector 36 can be configured to engage an entirety of the inner side of the right sleeve 17 with the portion of the right side 16 of the shirt body 14, such that the inner side of the right sleeve 17 is contiguously engaged from a right armpit 38 to an end of the right sleeve 13 with the portion of the right side 16 of the shirt body 14.

The left connector 42 can be configured to engage an entirety of the inner side the left sleeve 19 with the portion of the left side 18 of the shirt body 14, such that the inner side of the left sleeve 19 is contiguously engaged from a left armpit 44 to an end of the left sleeve 15 with the portion of the left side 18 of the shirt body 14.

In operation, when the inner side of the right sleeve 17 is engaged with the portion of the right side 16 of the shirt body 14, the inner side of the left sleeve 19 is engaged with the portion of the left side 18 of the shirt body 14, or combinations thereof, movement of the user's right arm 46*a*, left arm 46*b*, or combinations thereof away from the user's torso 48 can be restrained by the right sleeve 30, left sleeve 32, or combinations thereof. As such, the user 12 can maintain movement of the user's right arm 46*a*, left arm 46*b*, or combinations thereof in synchronization with a rotation of the user's torso 48 during execution of swings by the user 12.

The right connector 36 can be connected proximate the right armpit 38 of the shirt body 14.

In one or more embodiments, the right connector 36 can include a right connector first portion 34*a*, such as a first half of a zipper, disposed on the inner side of the right sleeve 17. The right connector 36 can include a right connector second portion 34*b* disposed on a portion of the right side 16, such as along a right inseam 52 of the shirt body 14. The right connector second portion 34*b* can be a second half of a zipper configured to engage with the right connector first portion 34*a*, thereby engaging the right sleeve 30 with the right side 16.

The left connector 42 can be connected proximate the left armpit 44 of the shirt body 14.

In one or more embodiments, the left connector 42 can include a left connector first portion 40*a*, such as a first half of a zipper, disposed on the inner side of the left sleeve 19. The left connector 42 can include a left connector second portion 40*b* disposed on a portion of the left side 18, such as along a left inseam 54 of the shirt body 14. The left connector second portion 40*b* can be a second half of a zipper configured to engage with the left connector first portion 40*a*; thereby engaging the left sleeve 32 with the left side 18.

In one or more embodiments, the right connector 36 and left connector 42 can each be zippers, buttons, snaps, hook and loop fasteners, other fasteners, or combinations thereof.

The swing training shirt 10 can have a first tab 21 connected with the right sleeve 30 at or above the right connector 36. The first tab 21 can be configured to be held by the user 12 to provide a tension to the shirt body 14; thereby allowing the user 12 to close the right connector 36 to engage at least a portion of the inner side the right sleeve 17 with a portion of the right side 16 of the shirt body 14.

The swing training shirt 10 can have a second tab 23 connected with the left sleeve 32 at or above the left connector 42. The second tab 23 can be configured to be held by the user 12 to provide a tension to the shirt body 14, thereby allowing the user 12 to close the left connector 42 to engage at least a portion of the inner side the left sleeve 19 with a portion of the left side 18 of the shirt body 14.

In one or more embodiments, the first tab 21 can be connected to an outer portion of the right sleeve 30 as shown, or the first tab 21 can be connected to an inner portion of the right seam 22*a* between the right sleeve 30 and the shirt body 14.

In one or more embodiments, the second tab 23 can be connected to an outer portion of the left sleeve 32, or the second tab 23 can be connected to an inner portion of the left seam 22*b* between the left sleeve 32 and the shirt body 14 as shown.

In operation, the user 12 can hold the first tab 21 while closing the right connector 36. The first tab 21 can allow the user 12 to apply tension to the shirt body 14 and right sleeve 30; thereby allowing the right connector 36 to engage the right sleeve 30 with the right side 16 of the shirt body 14. For example, if the right connector 36 is a zipper, the first tab 21 can be held by the user 12 to allow the zipper to be closed.

In operation, the user 12 can hold the second tab 23 while closing the left connector 42. The second tab 23 can allow the user 12 to apply tension to the shirt body 14 and left sleeve 32, thereby allowing the left connector 42 to engage the left sleeve 32 with the left side 18 of the shirt body 14. For example, if the left connector 42 is a zipper, the second tab 23 can be held by the user 12 to allow the zipper to be closed.

Figure 2:
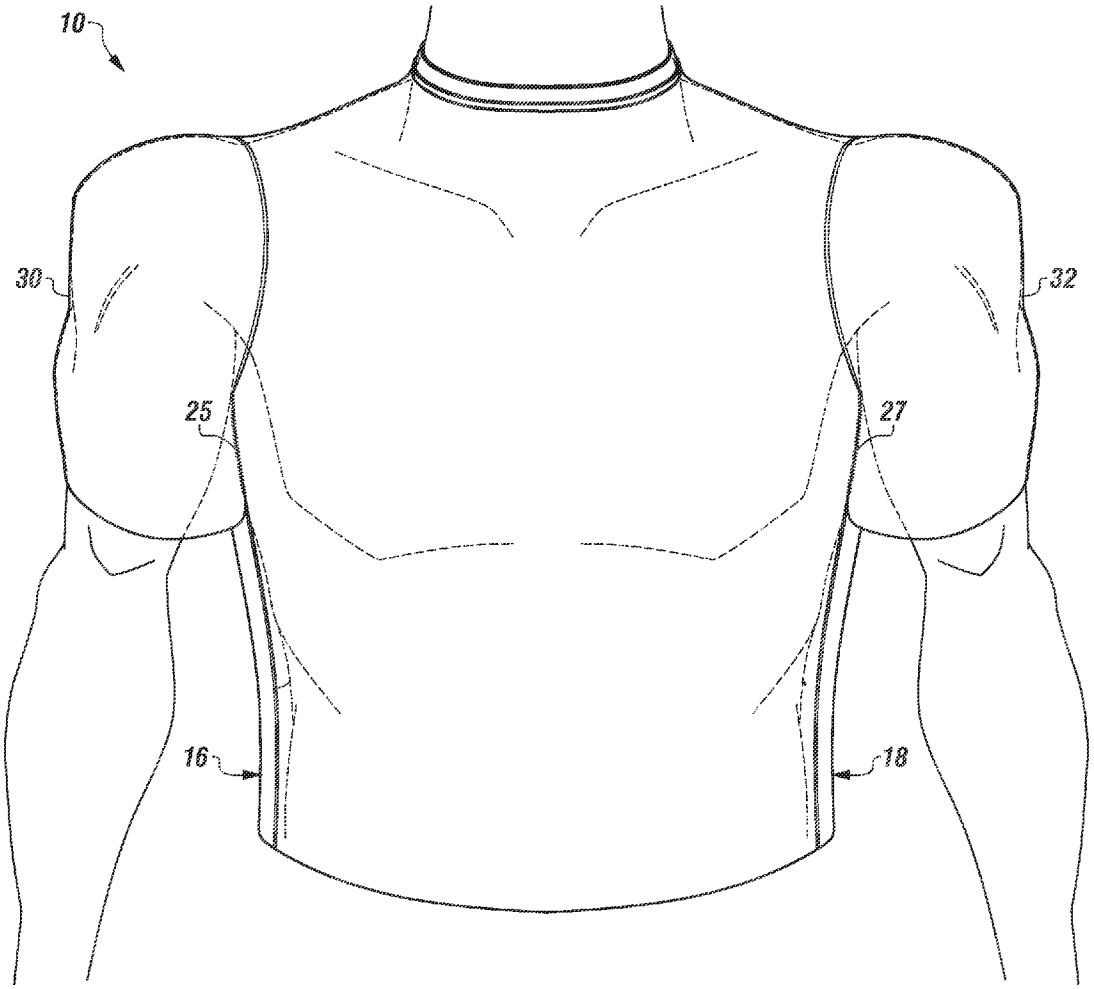
FIG. 2 depicts the swing training shirt having the left and right sleeves sewn to the shirt body according to one or more embodiments.

FIG. 2 depicts the swing training shirt 10 having a first seam 25 as the right connector according to one or more embodiments. For example, the inner side of the right sleeve 30 can be sewn to the right side 16 by the first seam 25, thereby restraining movement of the user's right arm away from the user's torso and allowing the user to maintain movement of the user's right arm in synchronization with the rotation of the user's torso during execution of swings.

The swing training shirt 10 can have a second seam 27 as the left connector. For example, the inner side of the left sleeve 32 can be sewn to the left side 18 by the second seam 27, thereby restraining movement of the user's left arm away from the user's torso and allowing the user to maintain movement of the user's left arm in synchronization with the rotation of the user's torso during execution of swings.

Figure 3:
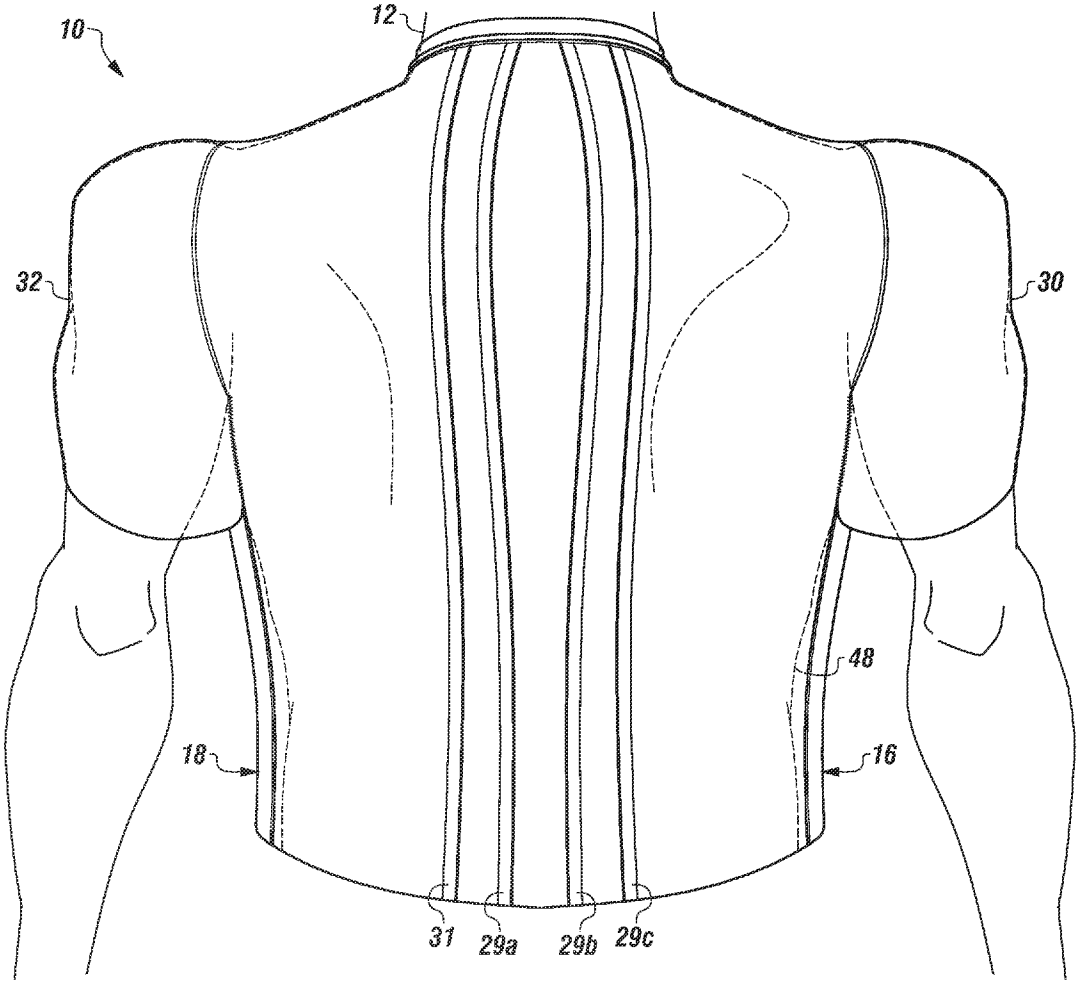
FIG. 3 depicts a back view of the swing training shirt having a tightening mechanism for tightening the swing training shirt about the user according to one or more embodiments.

FIG. 3 depicts a back view of the swing training shirt 10 having a right sleeve 30, right side 16, left sleeve 32, and left side 18 according to one or more embodiments.

The swing training shirt 10 can have a tightening mechanism, including a tightening mechanism first portion 31 connected with a back side of the swing training shirt 10.

The tightening mechanism first portion 31 can be configured to selectively engage with one or more tightening mechanism second portions 29*a*, 29*b*, and 29*c*, which can be connected with the back side of the swing training shirt 10.

Engaging the tightening mechanism first portion 31 with one of the tightening mechanism second portions 29*a*, 29*b*, and 29*c* can allow the user 12 to selectively tighten the swing training shirt 10 about the user's torso 48.

For example, the user 12 can engage the tightening mechanism first portion 31 with the tightening mechanism second portion 29*a* for a first level of tightness, the user 12 can engage the tightening mechanism first portion 31 with the tightening mechanism second portion 29*b* for a second level of tightness, and the user 12 can engage the tightening mechanism first portion 31 with the tightening mechanism second portion 29*c* for a third level of tightness.

As such, the user 12 can selectively tighten a back portion of the swing training shirt 10 about the user's torso 48 to provide a contoured fit between the swing training shirt 10 and the user's torso 48; thereby allowing for the swing training shirt 10 to provide tactile signals to the user 12 during execution of swings.

In one or more embodiments, the tightening mechanism can be a zipper, a hook and loop fastener, or a string for tightening the back side of the swing training shirt 10 about the user 12.

Figure 4:
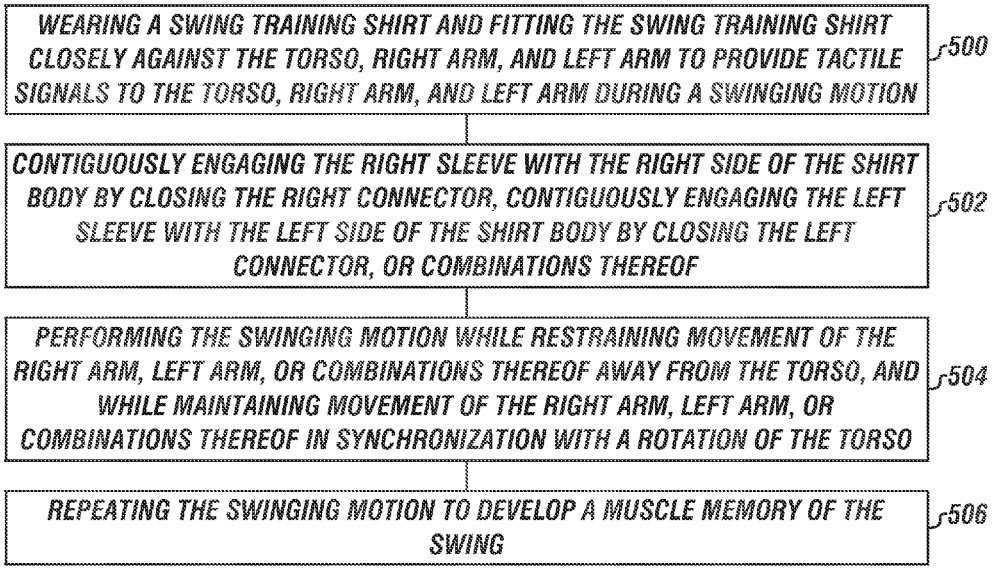
FIG. 4 depicts a method for training a swinging motion according to one or more embodiments.

FIG. 4 depicts a method for training a swing according to one or more embodiments.

The method can include wearing a swing training shirt and fitting the swing training shirt closely against the torso, right arm, and left arm to provide tactile signals to the torso, right arm, and left arm during a swinging motion, as illustrated by step 500.

The swing training shirt can include a shirt body for wearing on a torso, a right sleeve connected to the shirt body for wearing on a right arm, a left sleeve connected to the shirt body for wearing on a left arm, a right connector connected to the right sleeve and a right side of the shirt body, and a left connector connected to the left sleeve and a left side of the shirt body.

The method can include contiguously engaging the right sleeve with the right side of the shirt body by closing the right connector, contiguously engaging the left sleeve with the left side of the shirt body by closing the left connector, or combinations thereof, as illustrated by box 502.

The method can include performing the swinging motion while restraining movement of the right arm, left arm, or combinations thereof away from the torso, and while maintaining movement of the right arm, left arm, or combinations thereof in synchronization with a rotation of the torso, as illustrated by box 504.

For example, the swinging motion performed can be a golf swing motion, baseball swing motion, tennis swing motion, cricket swing motion, another sports swing motion, or combinations thereof.

The method can include repeating the swinging motion to develop a muscle memory of the swing, as illustrated by box 506.

While these embodiments have been described with emphasis on the embodiments, it should be understood that within the scope of the appended claims, the embodiments might be practiced other than as specifically described herein.

What is claimed is:

1. A swing training shirt for use in training users to execute swings, the swing training shirt comprising:

a. a shirt body configured to be worn on a torso of a user;

b. a right sleeve connected the shirt body, wherein the right sleeve is configured to be worn on a right arm of the user;

c. a left sleeve connected to the shirt body, wherein the left sleeve is configured to worn on a left arm of the user;

d. a right connector configured to engage at least a portion of an inner side of the right sleeve with a portion of a right side of the shirt body;

e. a left connector configured to engage at least a portion of an inner side the left sleeve with a portion of a left side of the shirt body, wherein when the inner side of the right sleeve is engaged with the portion of the right side of the shirt body and the inner side of the left sleeve is engaged with the portion of the left side of the shirt body movement of the user's arms away from the user's torso is restrained, thereby allowing the user to maintain movement of the user's arms in synchronization with a rotation of the user's torso during execution of a swing by the user;

f. a first tab connected with the right sleeve at or above the right connector, wherein the first tab is configured to be held by the user to provide a tension to the shirt body, thereby allowing the user to close the right connector to engage at least a portion of the inner side the right sleeve with the portion of the right side of the shirt body; and g. a second tab connected with the left sleeve at or above the left connector, wherein the second tab is configured to be held by the user to provide a tension to the shirt body, thereby allowing the user to close the left connector to engage at least a portion of the inner side the left sleeve with the portion of the left side of the shirt body.

2. The swing training shirt of claim 1, wherein:

a. the right connector is configured to engage an entirety of the inner side of the right sleeve with the portion of the right side of the shirt body such that the inner side of the right sleeve is contiguously engaged from a right armpit to an end of the right sleeve with the portion of the right side of the shirt body; and b. the left connector is configured to engage an entirety of the inner side the left sleeve with the portion of the left side of the shirt body such that the inner side of the left sleeve is contiguously engaged from a left armpit to an end of the left sleeve with the portion of the left side of the shirt body.

3. The swing training shirt of claim 1, wherein:

a. the swing training shirt is configured to fit closely to the user's torso and arms to provide the user with tactile signals during execution of the swing;

b. the swing training shirt is flexible to provide the user with a range of motion during execution of the swing; or c. combinations thereof.

4. The swing training shirt of claim 1, wherein the right connector and the left connector are zippers, buttons, snaps, hook and loop fasteners, and combinations thereof.

5. The swing training shirt of claim 1, wherein the swing training shirt comprises: a stretchable material, a wind resistant material, a material having a sun protection factor, a material having wicking properties, and combinations thereof.

6. The swing training shirt of claim 1, wherein:

a. the shirt body comprises:

(i) a top side, a right opening on a portion of the right side of the shirt body, and a left opening on a portion of the left side of the shirt body;

(ii) a collar on a portion of the top side, wherein the collar is configured to receive the user's head; and (iii) a bottom opening configured to receive a portion of the user's torso;

b. the right sleeve is connected to the right opening; and c. the left sleeve is connected to the left opening.

7. The swing training shirt of claim 6, wherein the collar is a round collar, a V-neck collar, a closed spandex collar, an open collar, a closeable collar, or combinations thereof.

8. The swing training shirt of claim 1, wherein the swing training shirt is configured to be worn by the user under another shirt or over another shirt.

9. The swing training shirt of claim 1, wherein the swing training shirt is configured for training a golf swing, a baseball swing, a tennis swing, a cricket swing, another sports swing, and combinations thereof.

10. The swing training shirt of claim 1, wherein:

a. the first tab is connected to an outer portion of the right sleeve, or the first tab is connected to an inner portion of a right seam disposed between the right sleeve and the shirt body; and b. the second tab is connected to an outer portion of the left sleeve, or the second tab is connected to an inner portion of a left seam disposed between the left sleeve and the shirt body.

11. The swing training shirt of claim 1, further comprising a tightening mechanism connected on a back side of the swing training shirt, wherein the tightening mechanism is configured to close to tighten the swing training shirt about the user.

12. The swing training shirt of claim 11, wherein the tightening mechanism is a zipper, a hook and loop fastener, or a string for tightening the back side of the swing training shirt about the user.

13. The swing training shirt of claim 1, wherein:

a. the right connector is a first seam, wherein the inner side of the right sleeve is sewn to the right side of the shirt body by the first seam for restraining movement of the user's right arm away from the user's torso, thereby allowing the user to maintain movement of the user's right arm in synchronization with the rotation of the user's torso during execution of the swing by the user;

b. the left connector is a second seam, wherein the inner side of the left sleeve is sewn to the left side of the shirt body by the second seam for restraining movement of the user's left arm away from the user's torso, thereby allowing the user to maintain movement of the user's left arm in synchronization with the rotation of the user's torso during execution of the swing by the user; or c. combinations thereof.

14. A swing training shirt for use in training users to execute swings, the swing training shirt comprising:

a. a shirt body configured to be worn on a torso of a user;

b. a right sleeve connected the shirt body, wherein the right sleeve is configured to be worn on a right arm of the user;

c. a left sleeve connected to the shirt body, wherein the left sleeve is configured to worn on a left arm of the user; and d. a right connector configured to engage at least a portion of an inner side of the right sleeve with a portion of a right side of the shirt body, a left connector configured to engage at least a portion of an inner side the left sleeve with a portion of a left side of the shirt body, or combinations thereof, wherein when the inner side of the right sleeve is engaged with the portion of the right side of the shirt body, the inner side of the left sleeve is engaged with the portion of the left side of the shirt body, or combinations thereof movement of the user's right arm, left arm, or combinations thereof away from the user's torso is restrained, thereby allowing the user to maintain movement of the user's right arm, left arm, or combinations thereof in synchronization with a rotation of the user's torso during execution of a swing by the user; and wherein, the right connector is a first seam, wherein the inner side of the right sleeve is sewn to the right side of the shirt body by the first seam for restraining movement of the user's right arm away from the user's torso, thereby allowing the user to maintain movement of the user's right arm in synchronization with the rotation of the user's torso during execution of the swing by the user; and further wherein the left connector is a second seam, wherein the inner side of the left sleeve is sewn to the left side of the shirt body by the second seam for restraining movement of the user's left arm away from the user's torso, thereby allowing the user to maintain movement of the user's left arm in synchronization with the rotation of the user's torso during execution of the swing by the user; or combinations thereof.

15. The swing training shirt of claim 14, wherein:

a. the right connector is configured to engage an entirety of the inner side of the right sleeve with the portion of the right side of the shirt body such that the inner side of the right sleeve is contiguously engaged from a right armpit to an end of the right sleeve with the portion of the right side of the shirt body;

b. the left connector is configured to engage an entirety of the inner side the left sleeve with the portion of the left side of the shirt body such that the inner side of the left sleeve is contiguously engaged from a left armpit to an end of the left sleeve with the portion of the left side of the shirt body; or c. combinations thereof.

* * * * *